US008813913B2

(12) United States Patent
Barzilai

(10) Patent No.: US 8,813,913 B2
(45) Date of Patent: Aug. 26, 2014

(54) EMERGENCY ACCESS APPARATUS AND METHOD

(76) Inventor: Yoav Barzilai, Ashkelon (IL)

( * ) Notice: Subject to any disclaimer, the term of this patent is extended or adjusted under 35 U.S.C. 154(b) by 60 days.

(21) Appl. No.: 13/246,381

(22) Filed: Sep. 27, 2011

(65) Prior Publication Data

US 2013/0075195 A1 Mar. 28, 2013

(51) Int. Cl.
*E06C 1/34* (2006.01)

(52) U.S. Cl.
USPC ..... 182/129; 182/206

(58) Field of Classification Search
USPC ..... 182/206, 129
See application file for complete search history.

(56) References Cited

U.S. PATENT DOCUMENTS

| | | | | | |
|---|---|---|---|---|---|
| 35,601 | A | | 6/1862 | Fobes | |
| 96,710 | A | | 11/1869 | Lotz | |
| 334,237 | A | | 6/1886 | Kbtchum | |
| 2,100,918 | A | * | 11/1937 | Ringman | 182/107 |
| 2,194,870 | A | * | 3/1940 | Pirsch | 182/189 |
| 3,825,096 | A | | 7/1974 | Mendes | |
| 4,243,121 | A | * | 1/1981 | Kiss et al. | 182/196 |
| 5,109,954 | A | * | 5/1992 | Skyba | 182/189 |
| 5,605,205 | A | * | 2/1997 | Douglas et al. | 182/198 |
| 5,941,344 | A | | 8/1999 | Spadaro | |
| 6,666,566 | B1 | | 12/2003 | Uke | |
| 2006/0151241 | A1 | | 7/2006 | Nir | |
| 2008/0087498 | A1 | * | 4/2008 | Barzilai | 182/193 |
| 2012/0152654 | A1 | * | 6/2012 | Marcus | 182/129 |

FOREIGN PATENT DOCUMENTS

JP 2002-011107 A 1/2002

OTHER PUBLICATIONS

An English Translation of an Office Action including an Israel Search Report both dated Oct. 23, 2011, which issued during the prosecution of Israel Patent Application No. 188822. (the relevant part only).
An English Translation of an Office Action dated Feb. 19, 2013, which issued during the prosecution of Israel Patent Application No. 188822. (the relevant part only).
An English Translation of an Office Action dated Jun. 15, 2014, which issued during the prosecution of Israel Patent Application No. 188822.

* cited by examiner

*Primary Examiner* — Alvin Chin-Shue
(74) *Attorney, Agent, or Firm* — Sughrue Mion, PLLC

(57) ABSTRACT

Emergency access apparatus including a ladder and at least one multi-functional emergency access module mounted on the ladder, the at least one multi-functional emergency access module including window glass shattering functionality and window frame engagement functionality.

9 Claims, 15 Drawing Sheets

100
104
102

110
115
114
111
112

120
126
T.N.T
125
127
121
123
122
124

EMERGENCY ACCESS APPARATUS AND METHOD

FIELD OF THE INVENTION

The present invention relates to emergency access apparatus, systems and methodologies generally and more particularly to emergency access equipment which includes a ladder.

BACKGROUND OF THE INVENTION

The following U.S. Patent documents are believed to represent the current state of the art:

U.S. Pat. Nos. 3,825,096; 334,237; 96,710 and 35,601.

SUMMARY OF THE INVENTION

The present invention seeks to provide improved emergency access apparatus, systems and methodologies. There is thus provided in accordance with a preferred embodiment of the present invention emergency access apparatus including a ladder and at least one multi-functional emergency access module mounted on the ladder, the at least one multi-functional emergency access module including window glass shattering functionality and window frame engagement functionality.

Preferably, the at least one multi-functional emergency access module also includes illumination functionality. Additionally or alternatively, the ladder is a dual segment ladder including upper and lower ladder segments, the at least one multi-functional emergency access module being mounted at a top end of the upper ladder segment and transverse base feet being mounted at a bottom end of the lower ladder segment.

Preferably, the emergency access apparatus also includes a selectably actuable explosive charge mounted on a selectably positionable support, which is rotatably mounted onto the ladder. Additionally or alternatively, the at least one multi-functional emergency access module includes a base element which includes a mounting leg adapted to be retained in a hollow top end of the ladder.

Preferably, the base element includes a first bore, the first bore being a throughgoing bore which extends rearwardly from a first forward opening to a first rearward opening. Additionally, the base element includes a depending portion extending downwardly from the first bore and being useful for retaining the ladder on a window frame.

Preferably, the first bore has a cross sectional configuration corresponding to that of the first forward opening along a first, principal portion of its length and then is narrowed to a cross sectional configuration corresponding to that of the first rearward opening at a second, rear portion thereof. Additionally, the base element is additionally formed with a second bore, the second bore being a non-throughgoing bore which extends rearwardly from a second forward opening and has a cross sectional configuration corresponding to that of the second forward opening. Additionally, the base element is additionally formed with a third bore, the third bore being a transverse bore which threadably receives a corresponding mounting shaft coupled to a mounting bracket onto which is mounted a battery operated light, operated by a microswitch.

Preferably, the base element is additionally formed with a fourth bore, the fourth bore being an elongate bore which extends transversely into communication with the second bore, and a fifth bore, the fifth bore being a throughgoing bore which extends transversely into communication with both of the first and second bores. Additionally, the base element is additionally formed with a sixth bore, the sixth bore being an elongate bore which extends transversely into communication with the first bore.

Preferably, the emergency access apparatus also includes an explosive charge detonating device mounted onto the base element and operated by a microswitch. Additionally or alternatively, the emergency access apparatus also includes a glass shattering elongate element disposed in the first bore and formed with a pointed forward end at a forward portion thereof. Additionally, the glass shattering elongate element has a transverse threaded socket formed adjacent a rearward end of the forward portion thereof, the socket receiving a screw which travels in the sixth bore and limits the forward axial travel of the elongate element in the first bore relative to the base element.

Preferably, the glass shattering elongate element is formed with a retaining notch. Additionally, the glass shattering elongate element extends rearwardly of the forward portion thereof as a shaft portion which terminates in a threaded end portion, which threadably engages a corresponding threaded socket in a manually operable retraction handle.

Preferably, the emergency access apparatus also includes a first coil spring operating as an axial compression spring which urges the glass shattering element forwardly and wherein manual retraction of the retraction handle acts against the force of the coil spring and cocks the glass shattering elongate element, which is retained in a retracted, cocked, orientation by engagement of a retaining pin in the retaining notch. Additionally, the retaining pin is a generally rectangular pin having rounded edges and is located within the fifth bore and is engaged by a screw at a threaded socket, the retaining pin being generally free to move up and down in the fifth bore.

Preferably, the emergency access apparatus also includes an elongate trigger element located in the second bore urged forwardly by a second coil spring, functioning as an axial compression spring, the elongate trigger element being formed with a notch for receiving the retaining pin when the trigger element is pushed backward into the second bore against the urging of the second coil spring. Additionally, the elongate trigger element has a transverse threaded socket formed adjacent a rearward end thereof, the socket receiving a screw which travels in the fourth transverse bore and thus limits the axial travel of the elongate trigger element in the second bore relative to the base element.

Alternatively, the first bore has a first cross sectional configuration, corresponding to that of the first forward opening along a first portion of its length, and a second cross sectional configuration, corresponding to that of the first rearward opening and wider than the first cross sectional configuration, along a second portion of its length. Additionally, the base element is additionally formed with a second bore, the second bore being a transverse bore which threadably receives a corresponding mounting shaft coupled to a mounting bracket onto which is mounted a battery operated light. Additionally, the base element is additionally formed with a third bore, the third bore being an elongate transverse bore which extends transversely into communication with the first bore.

Preferably, the emergency access apparatus also includes a glass shattering elongate element disposed in the first bore and formed with a pointed forward end. Additionally, the glass shattering elongate element includes mutually spaced integrally formed annular protrusions formed adjacent a rearward end thereof.

Preferably, the glass shattering elongate element has a transverse threaded socket formed adjacent a rearward end thereof, the socket receiving a screw which travels in the third bore and limits the axial travel of the glass shattering elongate element in the first bore relative to base element.

Preferably, the emergency access apparatus also includes a first explosive charge detonating device mounted onto the base element. Additionally or alternatively, the emergency access apparatus also includes a nose portion including a microswitch mounted thereon. Additionally, the emergency access apparatus also includes a second explosive charge detonating device mounted onto the base element and operated by the microswitch.

Preferably, the emergency access apparatus also includes a coil spring operating as an axial compression spring which urges the glass shattering element rearwardly and wherein detonation of an explosive charge in the second explosive charge detonating device temporarily overcomes the urging of the coil spring.

There is also provided in accordance with another preferred embodiment of the present invention an emergency access method including mounting at least one multi-functional emergency access module on a ladder, the at least one multi-functional emergency access module including window glass shattering functionality and placing the ladder adjacent a window to be accessed and breaking the window utilizing the glass shattering functionality.

Preferably, the emergency access module includes a handle and a trigger element and the breaking the window includes pulling the handle and touching the window with the trigger element. Alternatively, the emergency access module includes a nose portion and the breaking the window includes touching the window with the nose portion.

Preferably, the emergency access method also includes detonating an explosive charge simultaneously with the breaking the window. Additionally or alternatively, the emergency access method also includes illuminating a light simultaneously with the breaking the window. Additionally or alternatively, the emergency access method also includes retaining the ladder on a window frame of the window following the breaking the window.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figures 1A, 1B, 1C:
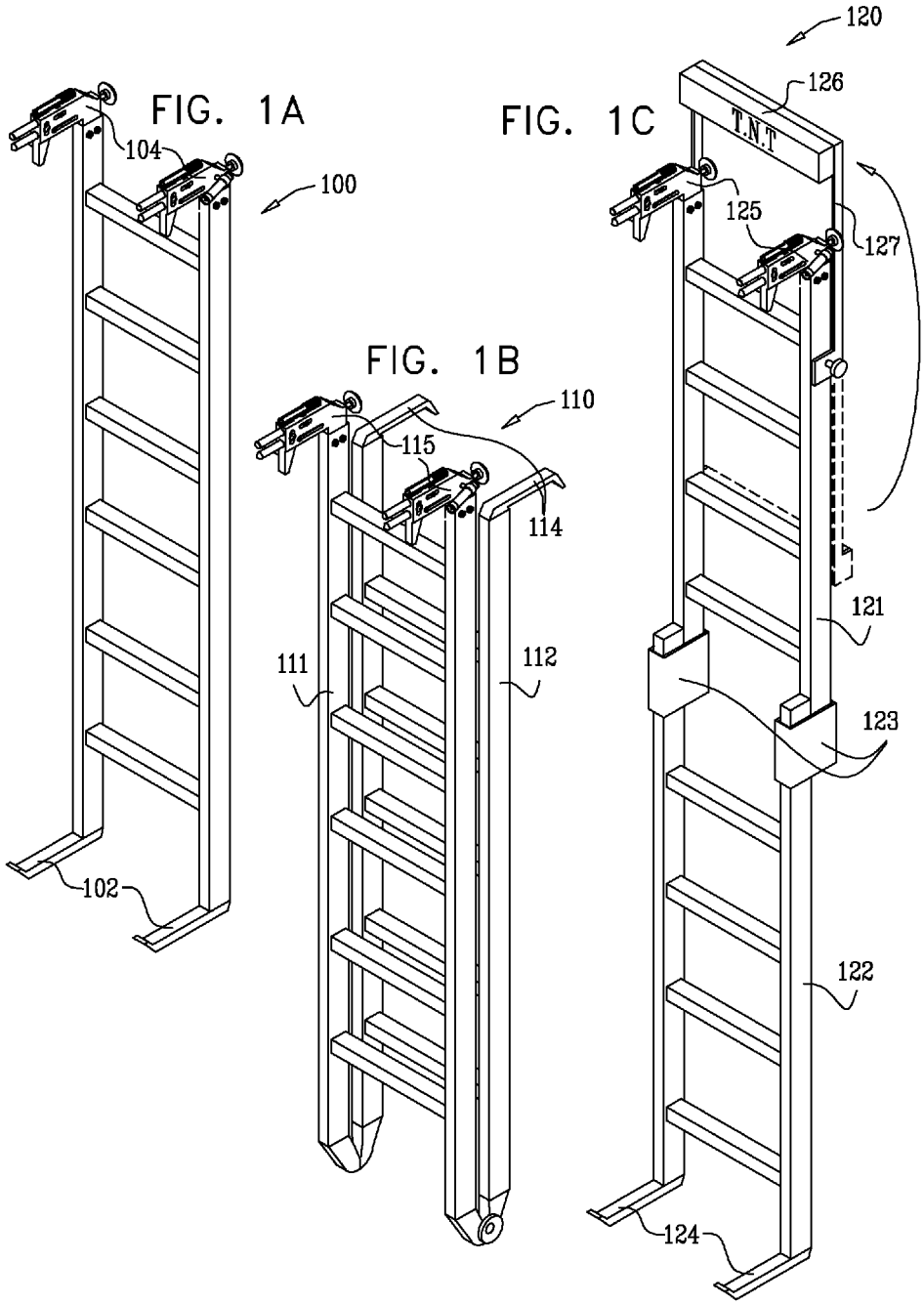
FIGS. 1A, 1B & 1C are simplified illustrations of ladder-based emergency access apparatus and systems constructed and operative in accordance with embodiments of the present invention.

Reference is now made to FIGS. 1A, 1B & 1C, which are simplified illustrations of ladder-based emergency access apparatus and systems constructed and operative in accordance with embodiments of the present invention.

FIG. 1A illustrates a single segment ladder 100 having transverse base feet 102 at a bottom thereof and having mounted on the top thereof ladder mountable multi-functional modules 104 constructed and operative in accordance with one or more of the embodiments of the present invention, which are described hereinbelow with reference to FIGS. 2A-5E.

FIG. 1B illustrates a hinged, dual segment ladder 110 including ladder segments 111 and 112 joined by hinges 113, ladder segment 112 having transverse base feet 114 at a bottom thereof and ladder segment 111 having mounted on the top thereof ladder mountable multi-functional modules 115 constructed and operative in accordance with one or more of the embodiments of the present invention, which are described hereinbelow with reference to FIGS. 2A-5E.

FIG. 1C illustrates a dual segment extension ladder 120 including mutually extendible ladder segments 121 and 122 joined by brackets 123, ladder segment 122 having transverse base feet 124 at a bottom thereof and ladder segment 121 having mounted on the top thereof ladder mountable multi-functional modules 125 constructed and operative in accordance with one or more of the embodiments of the present invention, which are described hereinbelow with reference to FIGS. 2A-5E. Additionally, an explosive charge 126 is mounted on a selectably positionable support 127, which is rotatably mounted onto ladder segment 121.

Figure 2A:
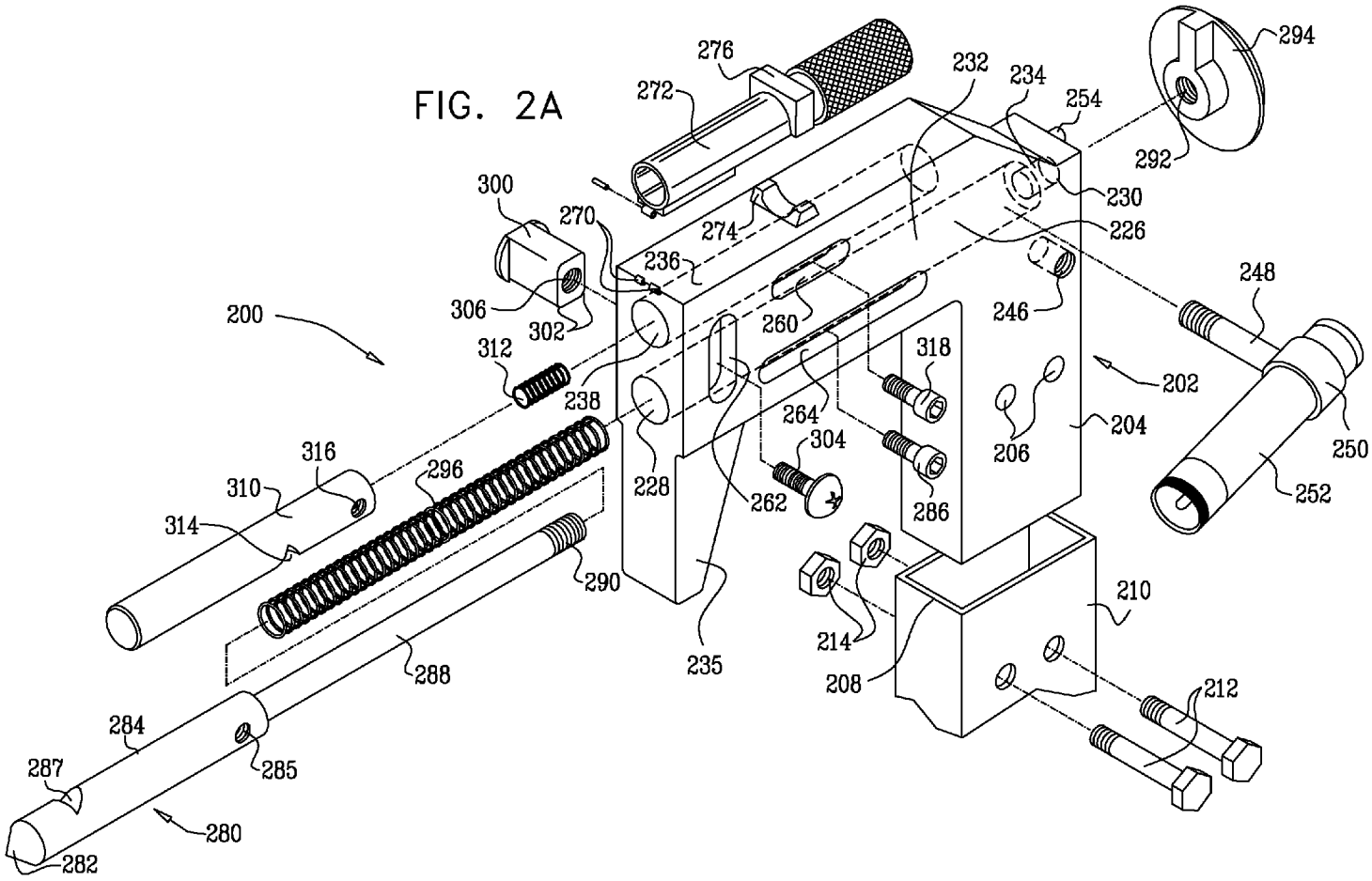
FIGS. 2A and 2B are simplified exploded-view illustrations of ladder mountable multi-functional modules constructed and operative in accordance with embodiments of the present invention.
Figure 3A:
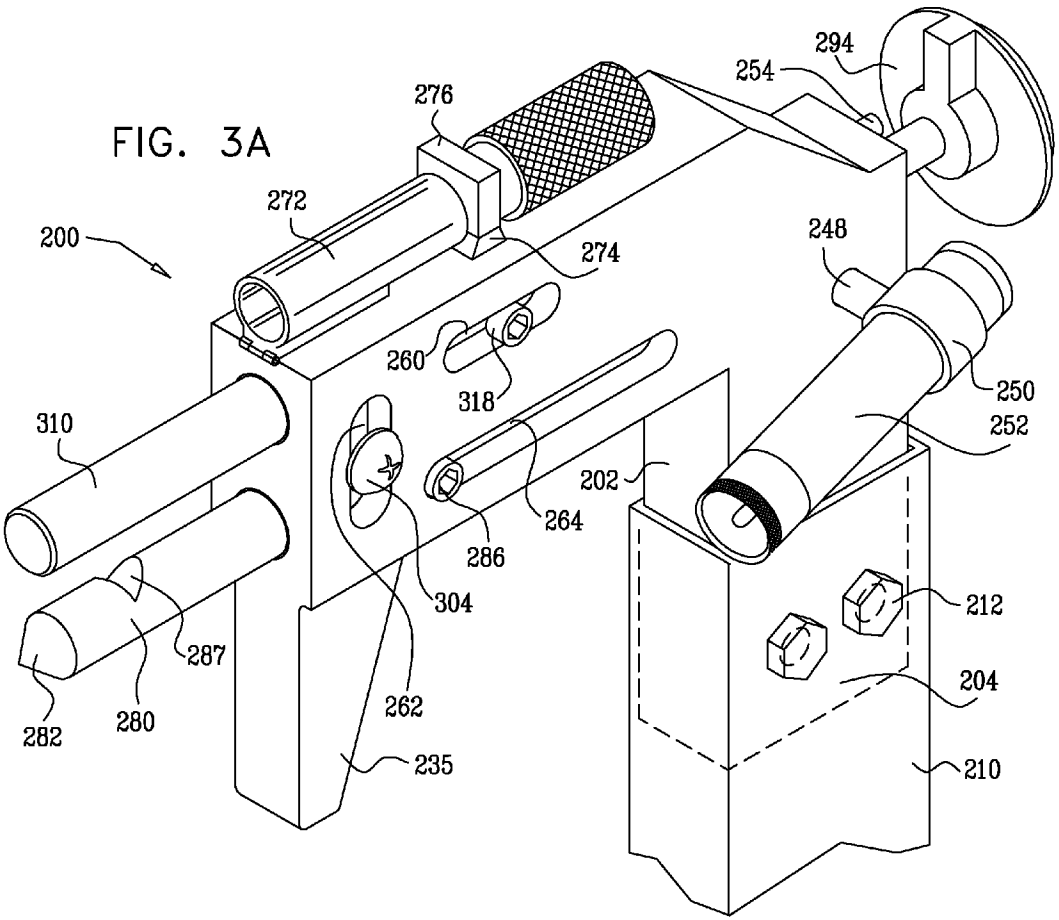
FIGS. 3A and 3B are simplified assembled-view illustrations of the ladder mountable multi-functional modules of FIGS. 2A and 2B respectively.

Reference is now made to FIGS. 2A and 3A, which are simplified respective exploded-view and assembled view illustrations of a ladder mountable multi-functional module 200 constructed and operative in accordance with a preferred embodiment of the present invention. As seen in FIGS. 2A and 3A, the ladder mountable multi-functional module 200 preferably comprises a base element 202, preferably formed of a solid block of aluminum.

Base element 202 includes a mounting leg 204 having a pair of throughgoing bores 206 which enable it to be retained in a hollow top end 208 of a ladder segment 210 by means of bolts 212 and cooperating nuts 214.

Base element 202 also includes a throughgoing bore 226 which extends rearwardly from a forward opening 228 to a rearward opening 230. Bore 226 has a cross sectional configuration corresponding to that of forward opening 228 along a first, principal portion 232 of its length and then is narrowed to a cross sectional configuration corresponding to that of rearward opening 230 at a second, rear portion 234. Preferably the base element 202 includes a depending portion 235 extending downwardly from the throughgoing bore 226 and being useful for retaining the ladder on a window frame following shattering of the glass in a window.

Base element 202 is additionally formed with a non-throughgoing bore 236 which extends rearwardly from a forward opening 238 and has a cross sectional configuration corresponding to that of forward opening 238.

A number of transverse bores are formed in base element 202 and extend generally transversely to bores 226 and 236. These preferably include a non-throughgoing at least partially threaded bore 246, which preferably threadably receives a corresponding mounting shaft 248 coupled to a mounting bracket 250 onto which is mounted a battery operated light 252. Preferably battery operated light 252 is selectably operated by a microswitch 254, preferably located in propinquity to bore 226.

An elongate bore 260 extends transversely into communication with bore 236 and a throughgoing elongate bore 262 extends transversely into communication with both of bores 226 and 236. A further elongate bore 264 extends transversely into communication with bore 226.

A forward hinge mounting element 270 for an explosive charge detonating device 272 is provided above forward opening 238. The explosive charge detonating device 272 is mounted onto element 270 and is strapped down onto a support element 274 by a bracket 276. Detonating device 272 is preferably also operated by microswitch 254.

A glass shattering elongate element 280 is disposed in bore 226 and is formed with a pointed forward end 282 at a relatively massive forward portion 284 thereof, which has a transverse threaded socket 285 formed adjacent the rearward end thereof. Socket 285 receives a screw 286 which travels in transverse bore 264 and thus limits the forward axial travel of elongate element 280 in bore 226 relative to base element 202. Forward portion 284 is formed with a retaining notch 287.

Elongate element 280 extends rearwardly of forward portion 284 as a shaft portion 288 which terminates in a threaded end portion 290, which threadably engages a corresponding threaded socket 292 in a manually operable retraction handle 294. A coil spring 296 operating as an axial compression spring urges glass shattering element 280 forwardly. Manual retraction of handle 294 acts against the force of spring 296 and cocks glass shattering elongate element 280. The glass shattering elongate element 280 is retained in its retracted, cocked, orientation by engagement of a retaining pin 300 in retaining notch 287. When elongate element 280 is in its retracted orientation, shown in FIG. 3A, forward portion 284 is located within bore portion 232 and shaft portion 288 is located within bore portion 234.

Retaining pin 300 is a generally rectangular pin having somewhat rounded edges 302. Retaining pin 300 is located within throughgoing bore 262 and is engaged by a screw 304 at a threaded socket 306. Retaining pin 300 is generally free to move up and down in throughgoing transverse bore 262.

An elongate trigger element 310 is located in bore 236 and is urged forwardly by a coil spring 312, functioning as an axial compression spring. Elongate trigger element 310 is formed with a notch 314, for receiving pin 300 when trigger element 310 is pushed backward into bore 236 against the urging of spring 312. Elongate trigger element 310 has a transverse threaded socket 316 formed adjacent the rearward end thereof. Socket 316 receives a screw 318 which travels in transverse bore 260 and thus limits the axial travel of elongate trigger element 310 in bore 236 relative to base element 202.

Figure 2B:
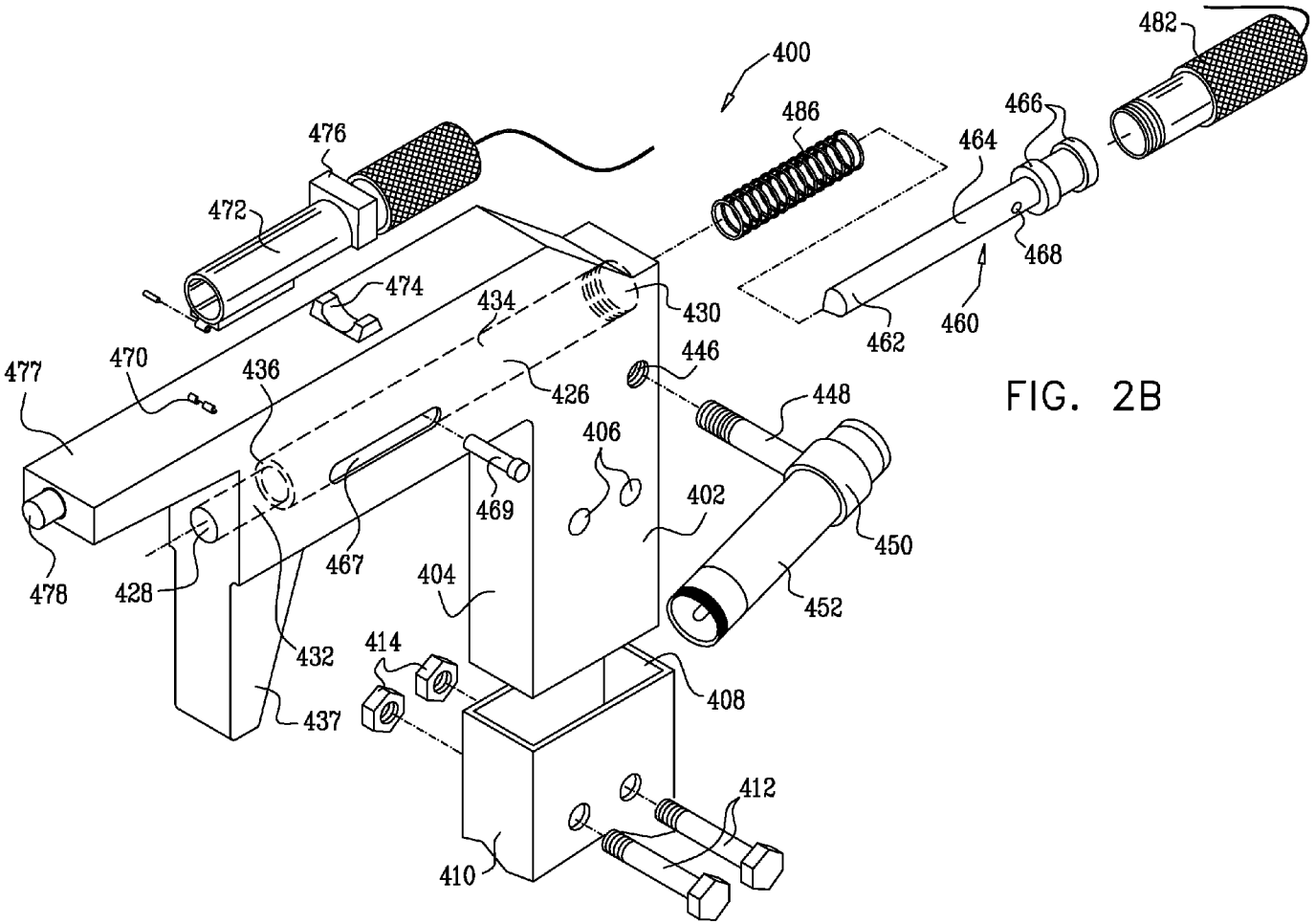
Figure 3B:
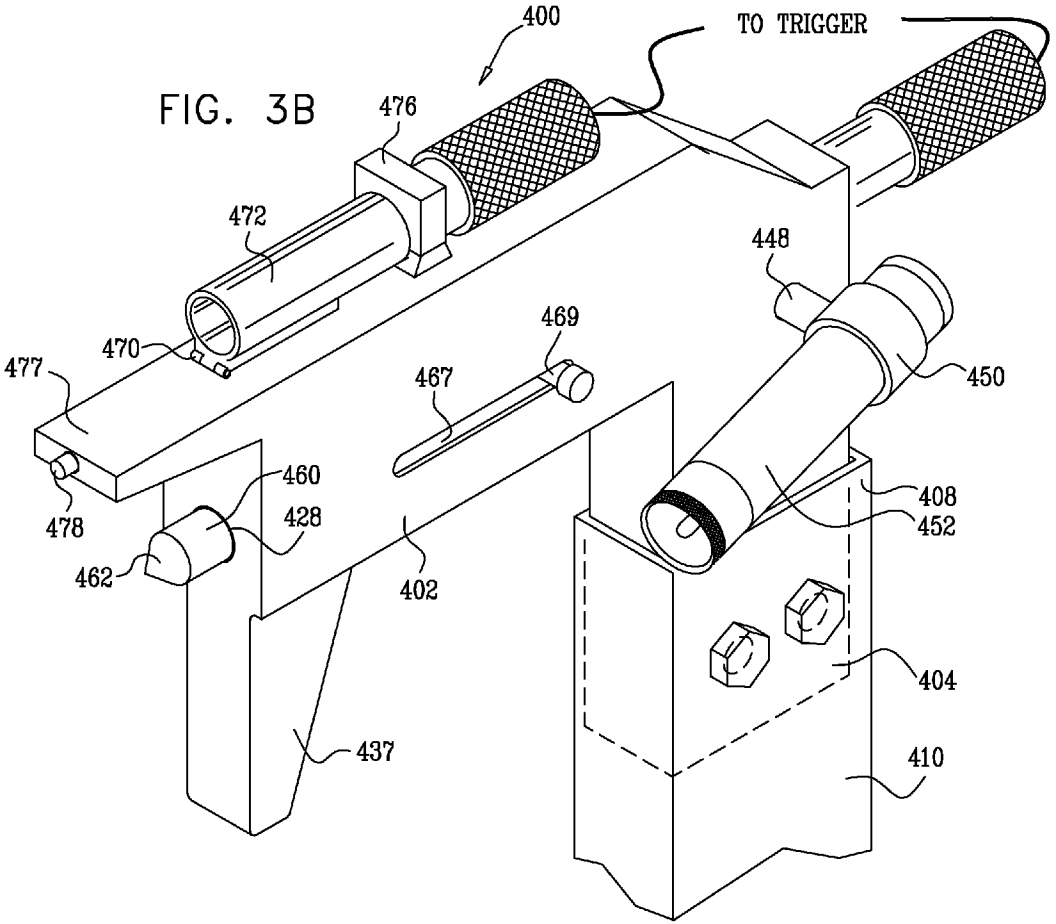

Reference is now made to FIGS. 2B and 3B, which are simplified respective exploded-view and assembled view illustrations of a ladder mountable multi-functional module 400 constructed and operative in accordance with a preferred embodiment of the present invention. As seen in FIGS. 2B and 3B, the ladder mountable multi-functional module 400 preferably comprises a base element 402, preferably formed of a solid block of aluminum.

Base element 402 includes a mounting leg 404 having a pair of throughgoing bores 406 which enable it to be retained in a hollow top end 408 of a ladder segment 410 by means of bolts 412 and cooperating nuts 414.

Base element 402 also includes a throughgoing bore 426 which extends rearwardly from a forward opening 428 to a rearward opening 430. Bore 426 has a first cross sectional configuration corresponding to that of forward opening 428 along a first portion 432 of its length and then widens to a second cross sectional configuration at a second, intermediate portion 434 extending to rearward opening 430. The junction between first portion 432 and intermediate portion 434 defines a shoulder 436.

Preferably, base element 402 includes a depending portion 437 extending downwardly from the throughgoing bore 426 and being useful for retaining the ladder on a window frame following shattering of the glass in a window.

A number of transverse bores are formed in base element 402 and extend generally transversely to bore 426. These preferably include a non-throughgoing at least partially threaded bore 446, which preferably threadably receives a corresponding mounting shaft 448 coupled to a mounting bracket 450 onto which is mounted a battery operated light 452.

A glass shattering elongate element 460 is disposed in bore 426 and is formed with a pointed forward end 462 at a relatively massive main portion 464 thereof, which has mutually spaced integrally formed annular protrusions 466 formed adjacent the rearward end thereof. Protrusions 466 function as pistons to move element 460 forwardly in response to detonation of an explosive charge rearwardly thereof, as is described hereinbelow.

An elongate bore 467 extends transversely into communication with bore 426. Elongate element 460 has a transverse threaded socket 468 formed adjacent the rearward end thereof. Socket 468 receives a screw 469 which travels in elongate bore 467 and thus limits the axial travel of elongate element 460 in bore 426 relative to base element 402.

A hinge mounting element 470 for an explosive charge detonating device 472 is provided above forward opening 428. The explosive charge detonating device 472 is mounted onto element 470 and is strapped down onto a support element 474 by a bracket 476.

It is noted that base element 402 extends forwardly of forward opening 428 at a nose portion 477, which defines a desired "stand-off" separation between forward opening 428 and a glass pane to be shattered. A microswitch 478, operating as a trigger, is preferably mounted on nose portion 477.

Elongate element 460 is arranged to be driven forwardly by an explosive charge contained in an explosive charge detonating device 482 threadably mounted onto rear opening 430 of bore 426. Detonating device 482 is preferably operated by microswitch 478 as is battery operated light 452.

A coil spring 486, preferably seated in bore 426 against shoulder 436, operating as an axial compression spring, urges glass shattering element 480 rearwardly. Detonation of the explosive charge in device 482 temporarily overcomes the urging of spring 486.

Reference is now made to FIGS. 4A, 4B, 4C, 4D and 4E, which are simplified partially pictorial, partially sectional illustrations of five stages in the operation of the ladder mountable multi-functional module of FIGS. 2A and 3A.

Figure 4A:
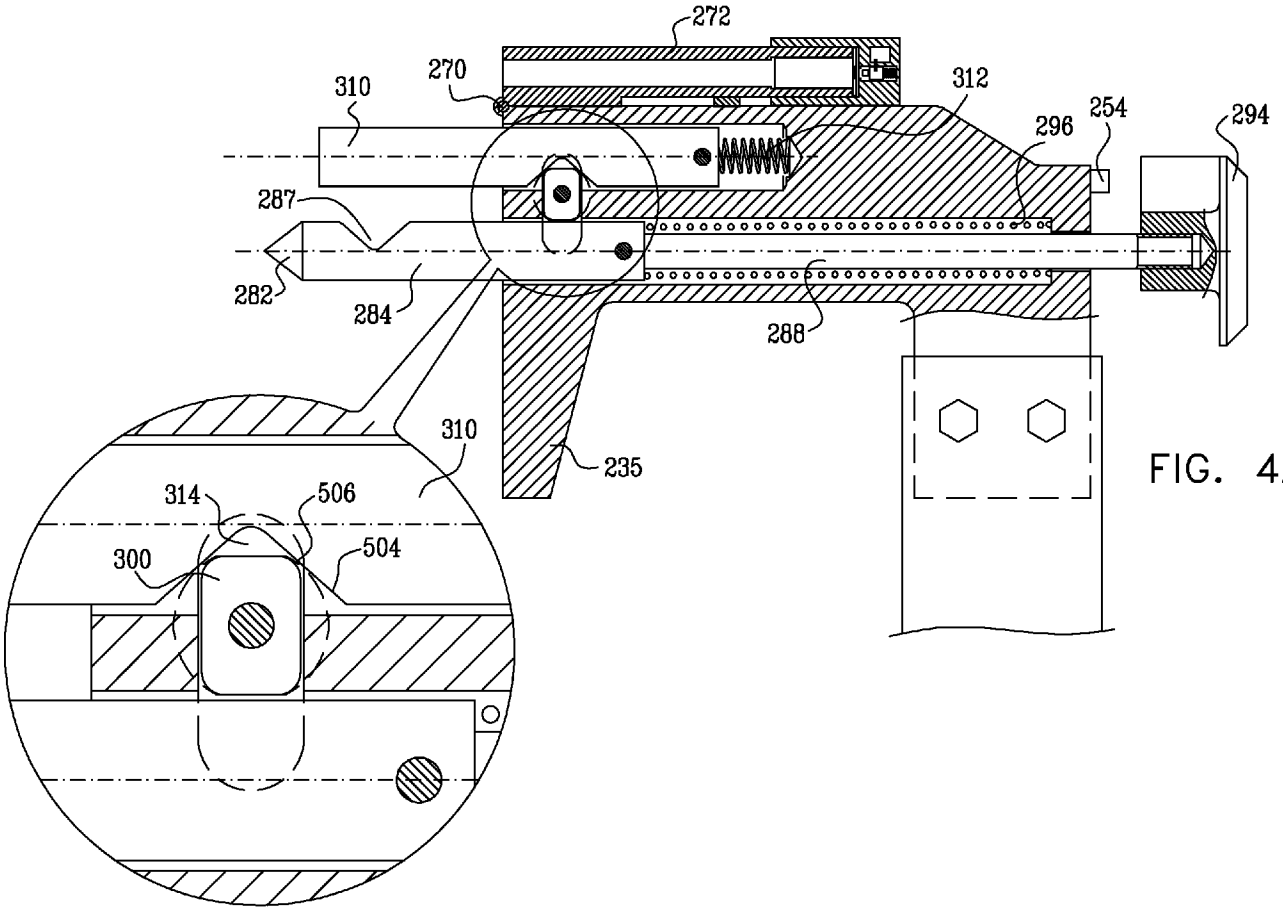
FIGS. 4A, 4B, 4C, 4D and 4E are simplified partially pictorial, partially sectional illustrations of five stages in the operation of the ladder mountable multi-functional model of FIGS. 2A and 3A.

FIG. 4A illustrates an at rest orientation of the ladder mountable multi-functional module of FIGS. 2A and 3A in which spring 296 is relatively uncompressed and spring 312 is compressed. In order to ready the ladder mountable multi-functional module of FIGS. 2A and 3A for use, a user pulls back on handle 294 in a direction indicated by an arrow 500, thus compressing spring 296. Displacement of handle 294 provides a corresponding rearward displacement of forward portion 284 to a location wherein notch 287 underlies pin 300, allowing pin to escape from notch 314 in trigger element 310 and to be partially seated in notch 287 in forward portion 284, to an extent that it clears trigger element 310, allowing trigger element 310 to move axially forward as indicated by an arrow 502 until stopped by the engagement of screw 318 with a forward edge of bore 260. At this position of trigger element 310, spring 312 is uncompressed.

Figure 4B:
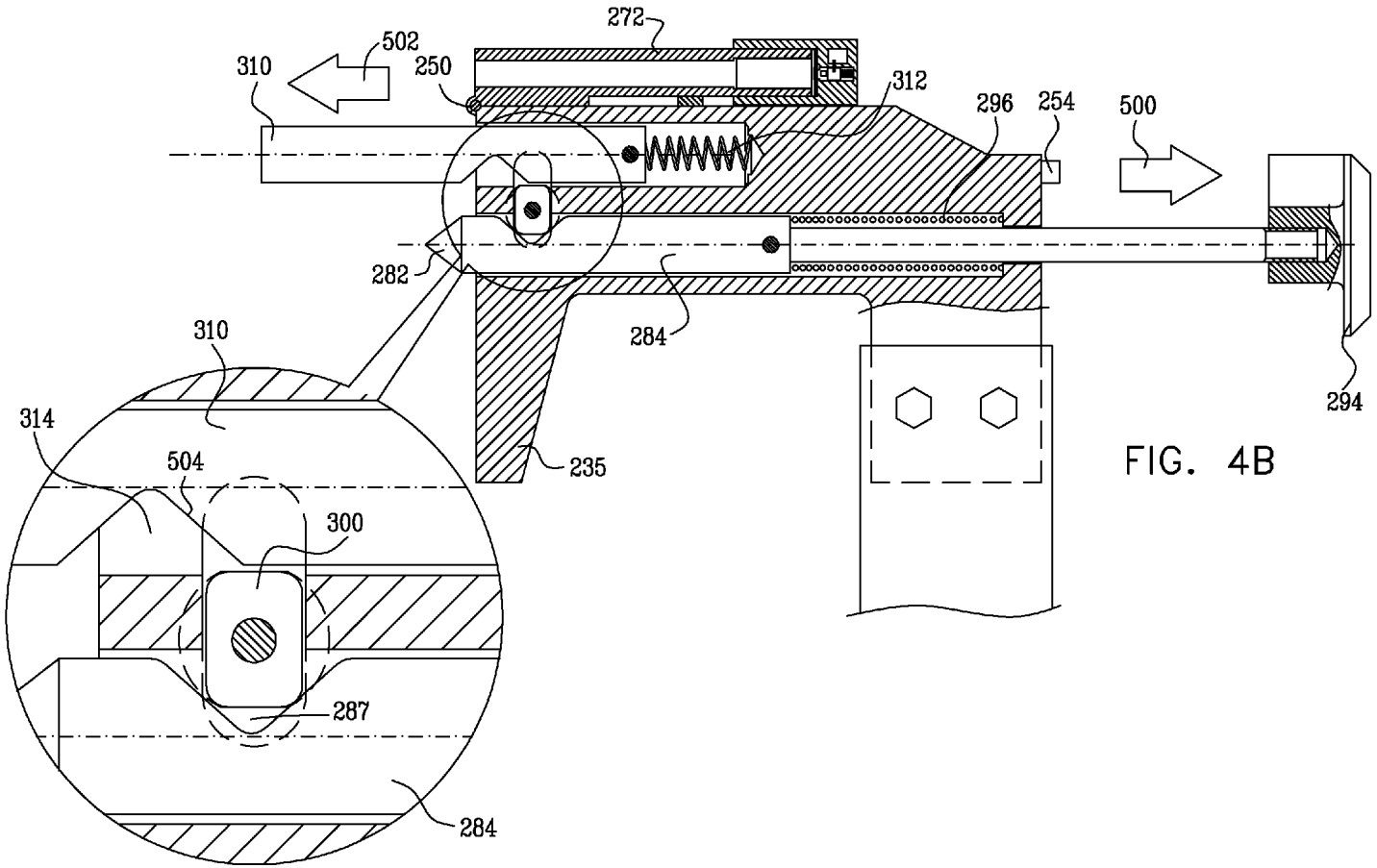
Figure 4C:
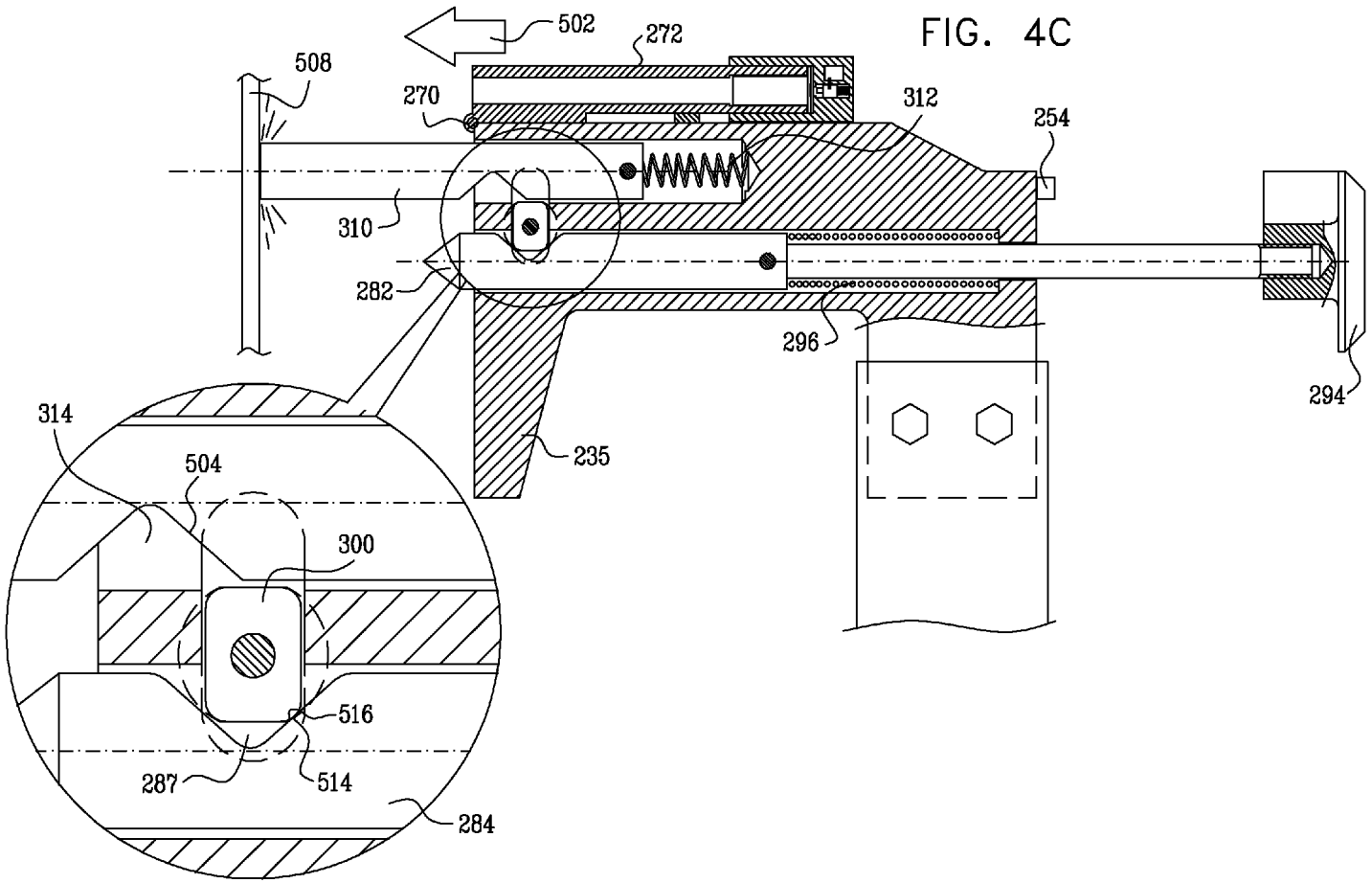

The escape of pin 300 from notch 314 in trigger element 310 normally is not due to the effect of gravity, but rather to the axial force exerted by spring 312 on trigger element 310 which produces a downward force on pin 300, in the sense of FIGS. 4A and 4C on pin 300 at the interface between an inclined forward facing surface 504 of notch 314 and a corresponding touching chamfered surface 506 of pin 300.

Figure 4D:
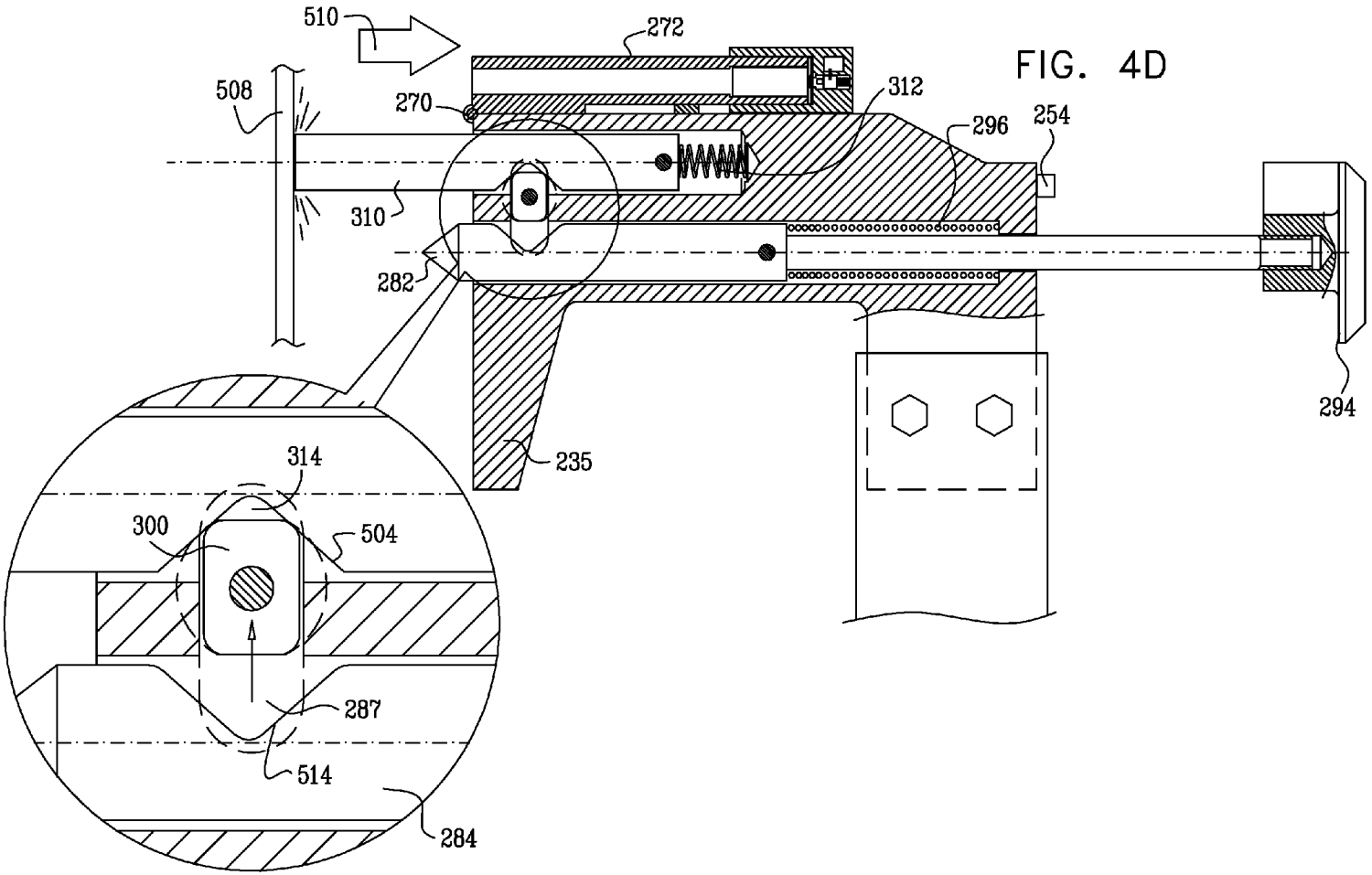
Figure 4E:
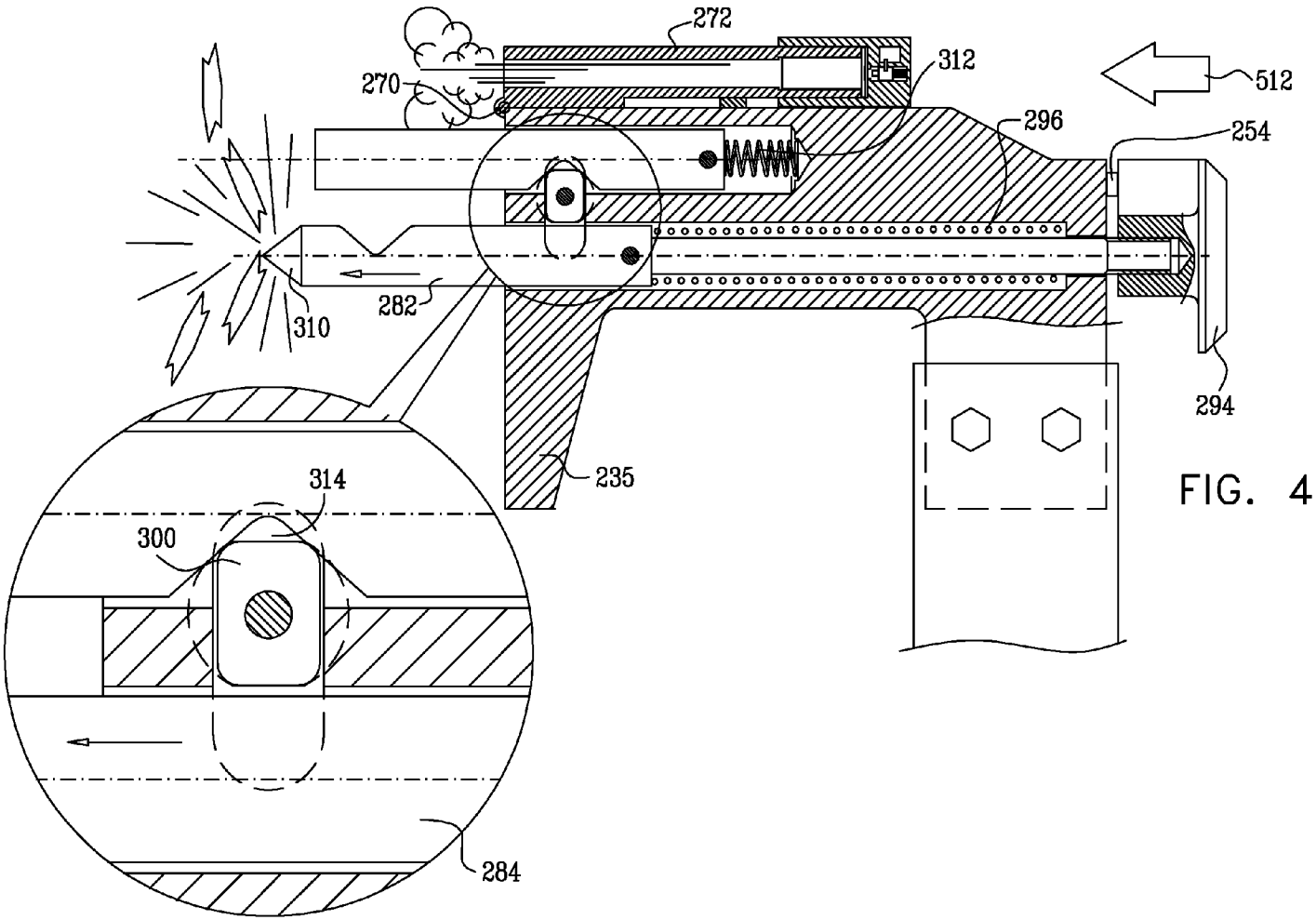

Turning now to FIGS. 4C, 4D and 4E, it is seen that when the forward end of trigger element 310 touches a window 508 (FIG. 4C) when in the operative orientation shown in FIG. 4B, trigger element 310 is pushed backward, as indicated by an arrow 510, to a location (FIG. 4D) wherein notch 314 overlies pin 300, allowing pin 300 to escape from notch 287 in trigger element 310 and to be partially seated in notch 314 in trigger element 310, to an extent that it clears forward portion 284, allowing forward portion 284 to move axially forward, as indicated by an arrow 512 (FIG. 4E), breaking window 508, until stopped by the engagement of screw 286 with a forward edge of bore 264. At this position of forward portion 284, spring 296 is uncompressed.

The escape of pin 300 from notch 287 in forward portion 284 is due to the axial force exerted by spring 296 on forward portion 284 which produces an upward force on pin 300, in the sense of FIGS. 4A-4E, at the interface between an inclined forward facing surface 514 of notch 287 and a corresponding touching chamfered surface 516 of pin 300.

It is a particular feature of the present invention that simultaneously with forward displacement of forward portion 284 and breaking of window 508 as shown in FIGS. 4C, 4D and 4E, an explosive charge is detonated in the explosive charge detonating device 272 providing the sense of firing, without actually firing a projectile. This coordinated detonation is preferably provided by microswitch 254, but alternatively may be provided by any other suitable mechanism which causes detonation of an explosive charge upon forward displacement of forward portion 284.

It is also a particular feature of the present invention that simultaneously with forward displacement of forward portion 284 and breaking of window 508 as shown in FIGS. 4C, 4D and 4E, battery operated light 252 is illuminated, preferably at the same time as an explosive charge is detonated in the explosive charge detonating device 272. This coordinated illumination and detonation is preferably provided by microswitch 254, but alternatively may be provided by any other suitable mechanism which causes illumination of battery operated light 252 and detonation of an explosive charge upon forward displacement of forward portion 284.

Figure 5A:
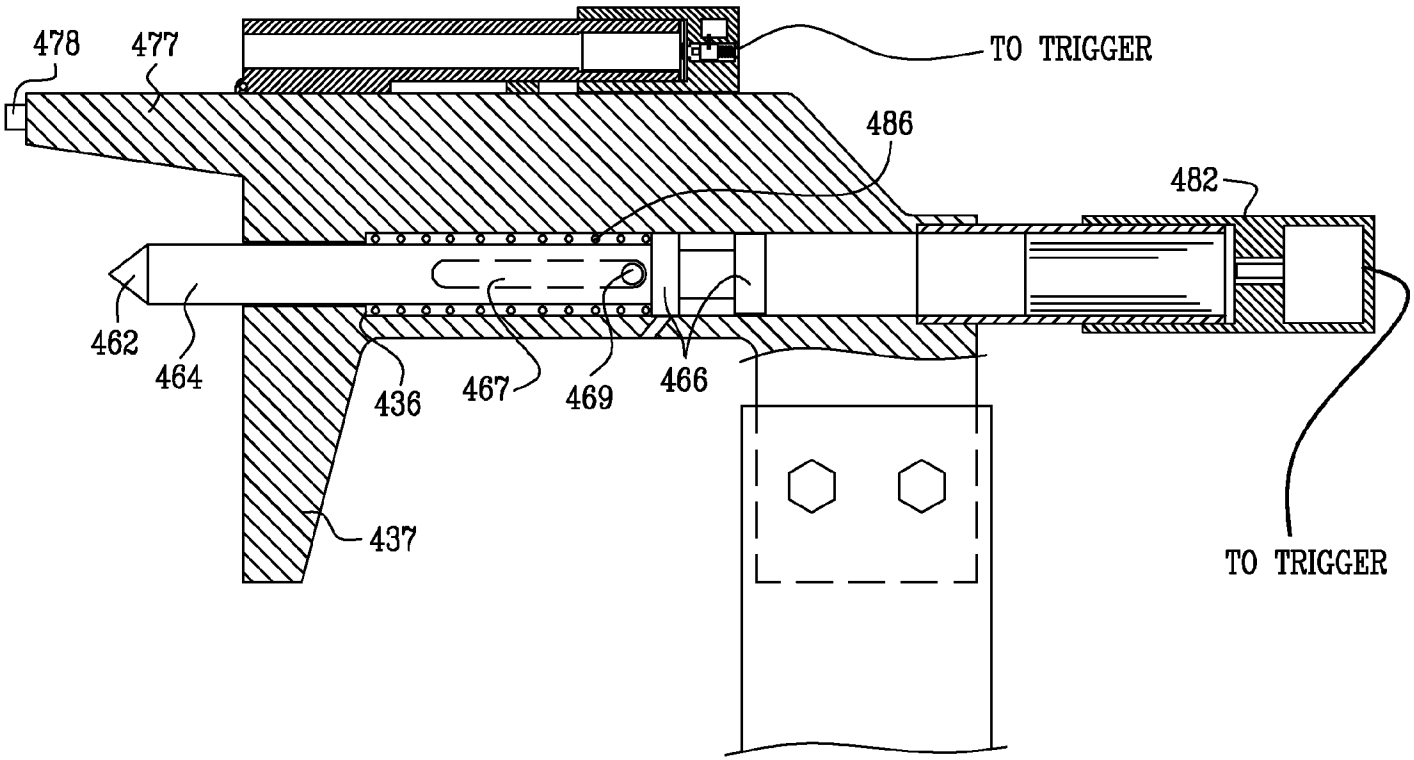
FIGS. 5A, 5B and 5C are simplified partially pictorial, partially sectional illustrations of three stages in the operation of the ladder mountable multi-functional model of FIGS. 2B and 3B.
Figure 5B:
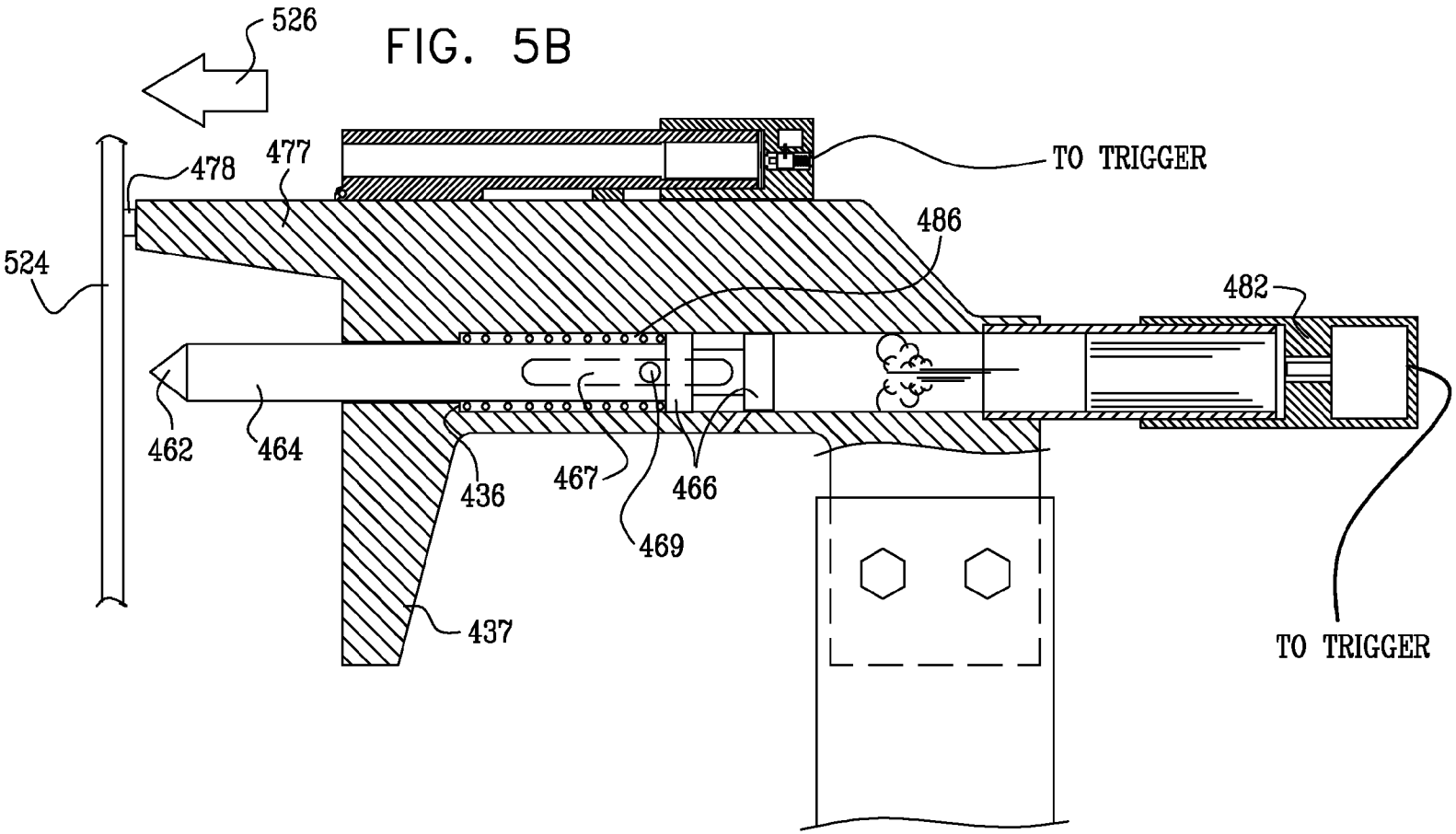
Figure 5C:
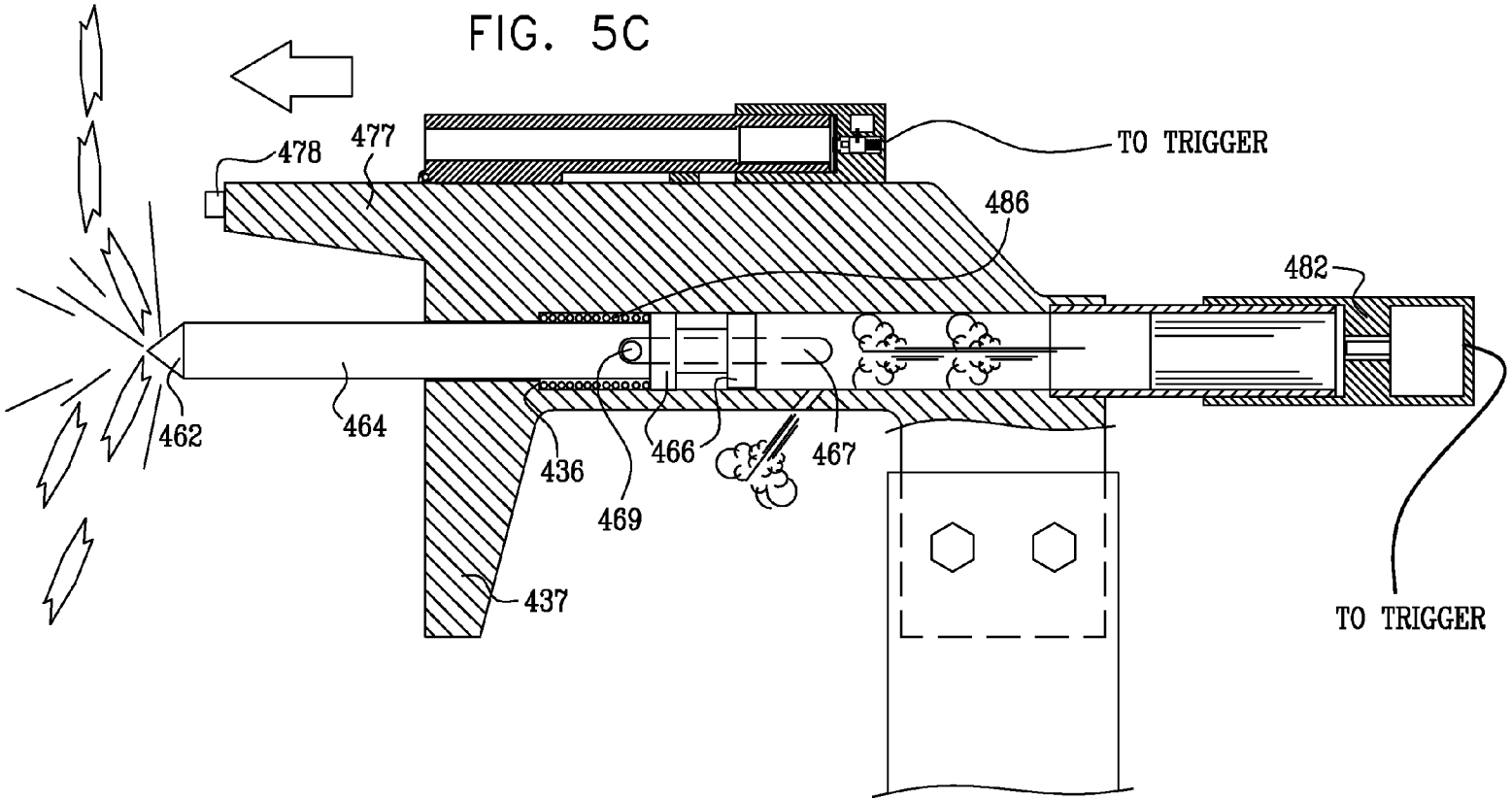

Reference is now made to FIGS. 5A, 5B and 5C, which are simplified partially pictorial, partially sectional illustrations of three stages in the operation of the ladder mountable multi-functional model of FIGS. 2B and 3B.

FIG. 5A illustrates an at rest orientation of the ladder mountable multi-functional module of FIGS. 2B and 3B in which spring 486 is relatively uncompressed.

Turning now to FIGS. 5B and 5C, it is seen that when nose portion 477 is pressed against a window 524 when in the operative orientation shown in FIG. 5B, microswitch 478 causes detonation of an explosive charge in explosive charge detonating device 482, forcing main portion 464 forwardly in a direction indicated by an arrow 526 against the urging of spring 486 breaking window 524, until stopped by the engagement of screw 469 with a forward edge of bore 467. At this position of main portion 464, spring 486 is compressed.

It is a particular feature of the present invention that simultaneously with forward displacement of main portion 464 and breaking of window 524 as shown in FIGS. 5B and 5C, an explosive charge is detonated in the explosive charge detonating device 472 providing the sense of firing, without actually firing a projectile. This coordinated detonation is preferably provided by microswitch 478, but alternatively may be provided by any other suitable mechanism which causes detonation of an explosive charge upon forward displacement of main portion 464.

It is also a particular feature of the present invention that simultaneously with forward displacement of main portion 464 and breaking of window 524 as shown in FIGS. 5B and 5C, battery operated light 452 is illuminated, preferably at the same time as an explosive charge is detonated in the explosive charge detonating device 472. This coordinated illumination and detonation is preferably provided by microswitch 478, but alternatively may be provided by any other suitable mechanism which causes illumination of battery operated light 452 and detonation of an explosive charge upon forward displacement of main portion 464.

Reference is now made to FIGS. 6A, 6B, 6C, 6D and 6E, which are simplified illustrations of stages in the operation of an alternative embodiment of ladder-based emergency access apparatus and systems constructed and operative in accordance with embodiments of the present invention.

Figure 6C:
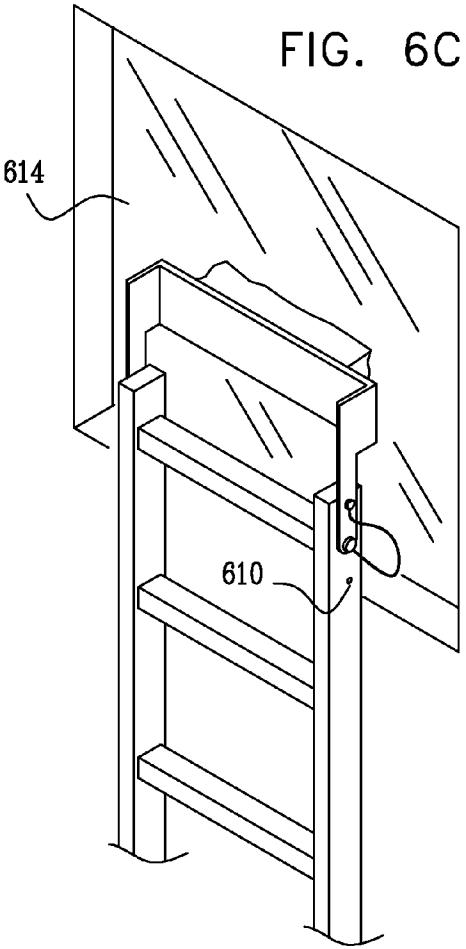
FIGS. 6A, 6B, 6C, 6D and 6E are simplified illustrations of three stages in the operation of an alternative embodiment of ladder-based emergency access apparatus and systems constructed and operative in accordance with embodiments of the present invention.
Figure 6B:
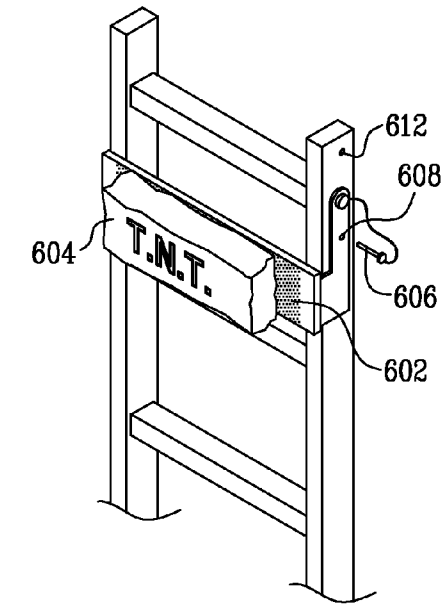
Figure 6A:
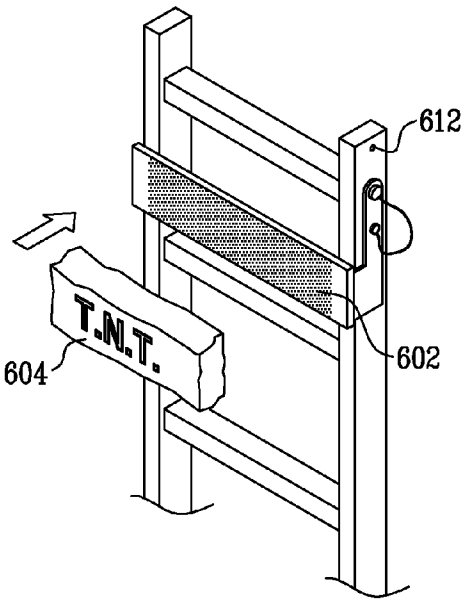

FIG. 6A shows a ladder 600 having an explosive material mounting platform assembly 602 pivotably mounted thereon. As seen in FIGS. 6A & 6B, an explosive material 604, such as a brick of explosive, may be mounted onto platform 602 in any suitable manner, as by the use of a suitable adhesive or other fastener. The platform assembly 602 is seen in FIGS. 6A & 6B in a pivoted down position. A retaining pin 606, engaging suitable apertures 608 and 610 in platform assembly 602 and in ladder 600 respectively, locks the platform assembly in the pivoted down position.

Figure 6E:
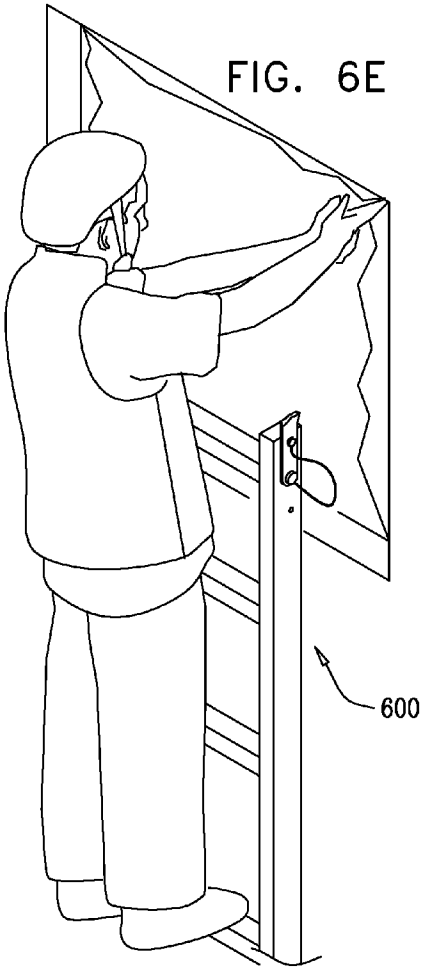
Figure 6D:
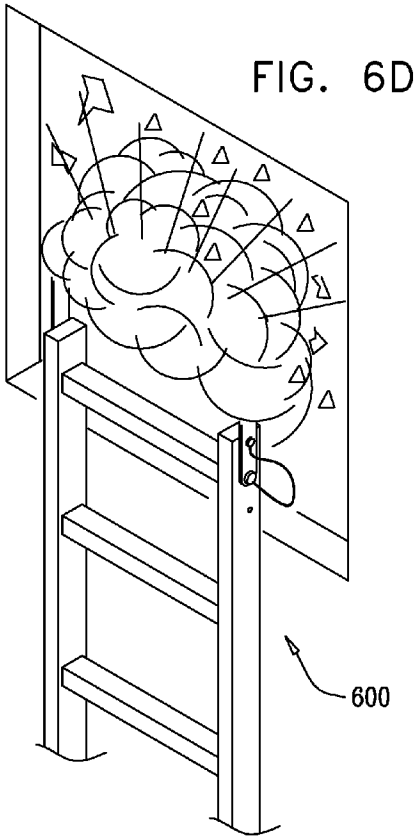

FIG. 6C shows mounting platform 602 shifted to a pivoted up position and locked therein by retaining pin 606 engaging aperture 608 and an aperture 612 in the ladder. With the mounting platform 602 in the pivoted up position, the explosive material 604 is seen resting against a reinforced window 614. Detonation of the explosive material 604 shatters window 614 (FIG. 6D) and permits firing therethrough (FIG. 6E).

It is appreciated that the embodiment of FIGS. 6A-6E may be employed separately or together with the embodiments of FIGS. 1A-5C in ladder-based emergency access apparatus and systems in accordance with the present invention.

It will be appreciated by persons skilled in the art that the present invention is not limited by what has been particularly shown and described hereinabove. Rather the scope of the present invention includes both combinations and subcombinations of the various features described hereinabove as well as modifications thereof which would occur to persons skilled in the art upon reading the foregoing description and which are not in the prior art.

The invention claimed is:

1. Emergency access apparatus comprising:

a ladder; and at least one multi-functional emergency access module mounted on said ladder, said at least one multi-functional emergency access module comprising window glass shattering functionality and window frame engagement functionality, said at least one multi-functional emergency access module comprising a base element which includes a mounting leg adapted to be retained in a hollow top end of said ladder, said base element including a first bore, said first bore being a throughgoing bore which extends rearwardly from a first forward opening to a first rearward opening;

said base element including a depending portion extending downwardly from said first bore and being useful for retaining said ladder on a window frame, said first bore having a cross sectional configuration corresponding to that of said first forward opening along a first, principal portion of its length and then being narrowed to a cross sectional configuration corresponding to that of said first rearward opening at a second, rear portion thereof; and said base element being additionally formed with a second bore, said second bore being a non-throughgoing bore which extends rearwardly from a second forward opening and has a cross sectional configuration corresponding to that of said second forward opening.

2. Emergency access apparatus according to claim 1 and wherein said at least one multi-functional emergency access module also includes illumination functionality.

3. Emergency access apparatus according to claim 1 and wherein said ladder is a dual segment ladder including upper and lower ladder segments, said at least one multi-functional emergency access module being mounted at a top end of said upper ladder segment and transverse base feet being mounted at a bottom end of said lower ladder segment.

4. Emergency access apparatus according to claim 1 and also comprising a selectably actuable explosive charge mounted on a selectably positionable support, which is rotatably mounted onto said ladder.

5. Emergency access apparatus according to claim 1 and wherein said base element is additionally formed with:

a third bore, said third bore being a transverse bore which threadably receives a corresponding mounting shaft coupled to a mounting bracket onto which is mounted a battery operated light, operated by a microswitch;

a fourth bore, said fourth bore being an elongate bore which extends transversely into communication with said second bore;

a fifth bore, said fifth bore being a throughgoing bore which extends transversely into communication with both of said first and second bores; and a sixth bore, said sixth bore being an elongate bore which extends transversely into communication with said first bore.

6. Emergency access apparatus according to claim 5 and also comprising:

an explosive charge detonating device mounted onto said base element and operated by a microswitch; and a glass shattering elongate element disposed in said first bore and formed with a pointed forward end at a forward portion thereof.

7. Emergency access apparatus according to claim 6 and wherein:

said glass shattering elongate element has a transverse threaded socket formed adjacent a rearward end of said forward portion thereof, said socket receiving a screw which travels in said sixth bore and limits the forward axial travel of said elongate element in said first bore relative to said base element;

said glass shattering elongate element is formed with a retaining notch; and said glass shattering elongate element extends rearwardly of said forward portion thereof as a shaft portion which terminates in a threaded end portion, which threadably engages a corresponding threaded socket in a manually operable retraction handle.

8. Emergency access apparatus according to claim 7 and also comprising a first coil spring operating as an axial compression spring which urges said glass shattering element forwardly and wherein:

manual retraction of said retraction handle acts against the force of said coil spring and cocks said glass shattering elongate element, which is retained in a retracted, cocked, orientation by engagement of a retaining pin in said retaining notch;

said retaining pin is a generally rectangular pin having rounded edges and is located within said fifth bore and is engaged by a screw at a threaded socket, said retaining pin being generally free to move up and down in said fifth bore.

9. Emergency access apparatus according to claim 8 and also comprising an elongate trigger element located in said second bore urged forwardly by a second coil spring, functioning as an axial compression spring, and wherein:

said elongate trigger element is formed with a notch for receiving said retaining pin when said trigger element is pushed backward into said second bore against the urging of said second coil spring; and said elongate trigger element has a transverse threaded socket formed adjacent a rearward end thereof, said socket receiving a screw which travels in said fourth transverse bore and thus limits the axial travel of said elongate trigger element in said second bore relative to said base element.

* * * * *